US006761181B1

(12) United States Patent
Tseng

(10) Patent No.: US 6,761,181 B1
(45) Date of Patent: Jul. 13, 2004

(54) MODULAR LEG ASSEMBLY FOR A CANOPY

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 23 days.

(21) Appl. No.: 10/331,531

(22) Filed: Dec. 30, 2002

(51) Int. Cl.[7] ..... E04H 15/36
(52) U.S. Cl. ..... 135/133
(58) Field of Search ..... 135/121, 122, 135/135, 115, 114, 118, 133; 52/82, 83, 63

(56) References Cited

U.S. PATENT DOCUMENTS 4,426,814 A * 1/1984 Stuhmer ..... 52/82
4,558,713 A * 12/1985 Hagler et al. ..... 135/159
4,733,508 A * 3/1988 Greenblatt ..... 52/91.1
4,910,928 A * 3/1990 Cellar, Jr. ..... 52/82
4,960,144 A * 10/1990 Wheatley et al. ..... 135/123
5,193,327 A * 3/1993 Goodenberger ..... 52/747.1
5,224,507 A * 7/1993 Vosse ..... 135/138
5,226,440 A * 7/1993 Fuhrman ..... 135/159
5,673,720 A * 10/1997 Cuthill ..... 135/98
5,779,386 A * 7/1998 Eichhorn ..... 403/329
6,263,895 B1 * 7/2001 Bang ..... 135/138

* cited by examiner

*Primary Examiner*—Leslie A. Braun
*Assistant Examiner*—Kofi Schulterbrandt
(74) *Attorney, Agent, or Firm*—Ladas & Parry

(57) ABSTRACT

A modular leg assembly includes at least three upright support members, each including an adjacent pair of planar first and second leg frames that are interconnected detachably. Vertical engaging sides of the first and second leg frames of each support member are close to and are connected detachably to each other, while vertical non-engaging sides of the same, which are opposite to the engaging sides, are spaced apart from each other. An annular link frame is mounted detachably on a top end of each support member. A top support frame is mounted detachably on the link frame for supporting a canopy thereon.

11 Claims, 8 Drawing Sheets

MODULAR LEG ASSEMBLY FOR A CANOPY

BACKGROUND OF THE INVENTION

1. Field of the Invention

The invention relates to a leg assembly, more particularly to a modular leg assembly for a canopy.

2. Description of the Related Art

Referring to FIGS. 1 and 2, a conventional leg assembly 1 for a canopy is shown to comprise a multi-way connector 11 disposed on top of the leg assembly 1, a plurality of curved support rods 12 connected to the multi-way connector 11, a plurality of four-way connectors 13, each of which is connected to a lower end of a respective one of the support rods 12, a plurality of horizontal linking rods 14, each of which is connected between an adjacent pair of the four-way connectors 13, a plurality of hollow upright leg members 15, each of which is connected pivotally to a lower end portion of a respective one of the four-way connectors 13, and a plurality of leg seats 16, each of which is connected fixedly to a lower end of a respective one of the leg members 15.

Referring to FIG. 2, in each junction of the four-way connector 13 and the leg member 15, there is provided an interlocking device 17 so as to stabilize connections among the connectors 11, 13, the support rods 12, the linking rods 14, and the leg members 15. Since the interlocking devices 17 are substantially similar in construction, only one interlocking device 17 will be described hereinafter. The interlocking device 17 includes an L-shaped retaining groove 171 formed in an extended section 131 of the four-way connector 13, and an engaging pin 172 that extends inwardly and radially from an inner surface of the leg member 15. The retaining groove 171 has an axial hole section 173 and a transverse hole section 174 that is transverse to the axial hole section 173. During assembly, the extended section 131 of the four-way connector 13 is sleeved into the leg member 15 in such a manner that the axial hole section 173 of the groove 171 can receive the engaging pin 172 of the leg member 15, after which the leg member 15 is rotated so that the engaging pin 172 engages the transverse hole section 174 of the groove 171 in the four-way connector 13 so as to prevent removal of the leg member 15 from the four-way connector 13.

Although the design of the conventional leg assembly 1 can achieve its intended purpose, however, in actual use, the leg members 15 cannot support stably the remaining elements of the leg assembly 1 since the leg members 15 are relatively thin. Furthermore, the number of the leg members 15 in the leg assembly 1 is relatively large such that a passage between each adjacent pair of the leg members 15 is relatively narrow, thereby inconveniencing the users. Moreover, the configuration of each interlocking device 17 can complicate and slow down the assembly process of the leg assembly 1. In addition, the interlocking devices 17 are difficult to assemble due to the structure of the curved upper support rods 12.

SUMMARY OF THE INVENTION

Therefore, the object of the present invention is to provide a modular leg assembly that is capable of overcoming the aforementioned drawbacks of the prior art.

According to the present invention, a modular leg assembly comprises at least three upright support members, an annular link frame, and a top support frame. Each of the upright support members includes an adjacent pair of planar first and second leg frames that are connected detachably to each other and that are adapted to stand one ground surface. Each of the first and second leg frames includes a vertical engaging side and a vertical non-engaging side opposite to the vertical engaging side. During assembly, the vertical engaging sides of the first and second leg frames of each of the support members are close to and are connected detachably to each other, and the vertical non-engaging sides of the first and second leg frames of each of the support members are spaced apart from each other. The link frame is mounted on a top end of each of the support members, and includes a plurality of corner connectors, each of which is connected detachably to a respective one of the support members, a plurality of horizontally-extending link members, each of which is connected telescopically to an adjacent pair of the corner connectors, and a plurality of first positioning units for positioning each of the link members between the adjacent pair of the corner connectors. A top support frame is mounted detachably on the link frame, and includes a central connector, a plurality of main support rod members, each of which is connected telescopically to the central connector and a respective one of the corner connectors, a plurality of second positioning units for positioning the central connector relative to the main support rod members, and a plurality of third positioning units for positioning the main support rod members relative to the corner connectors.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
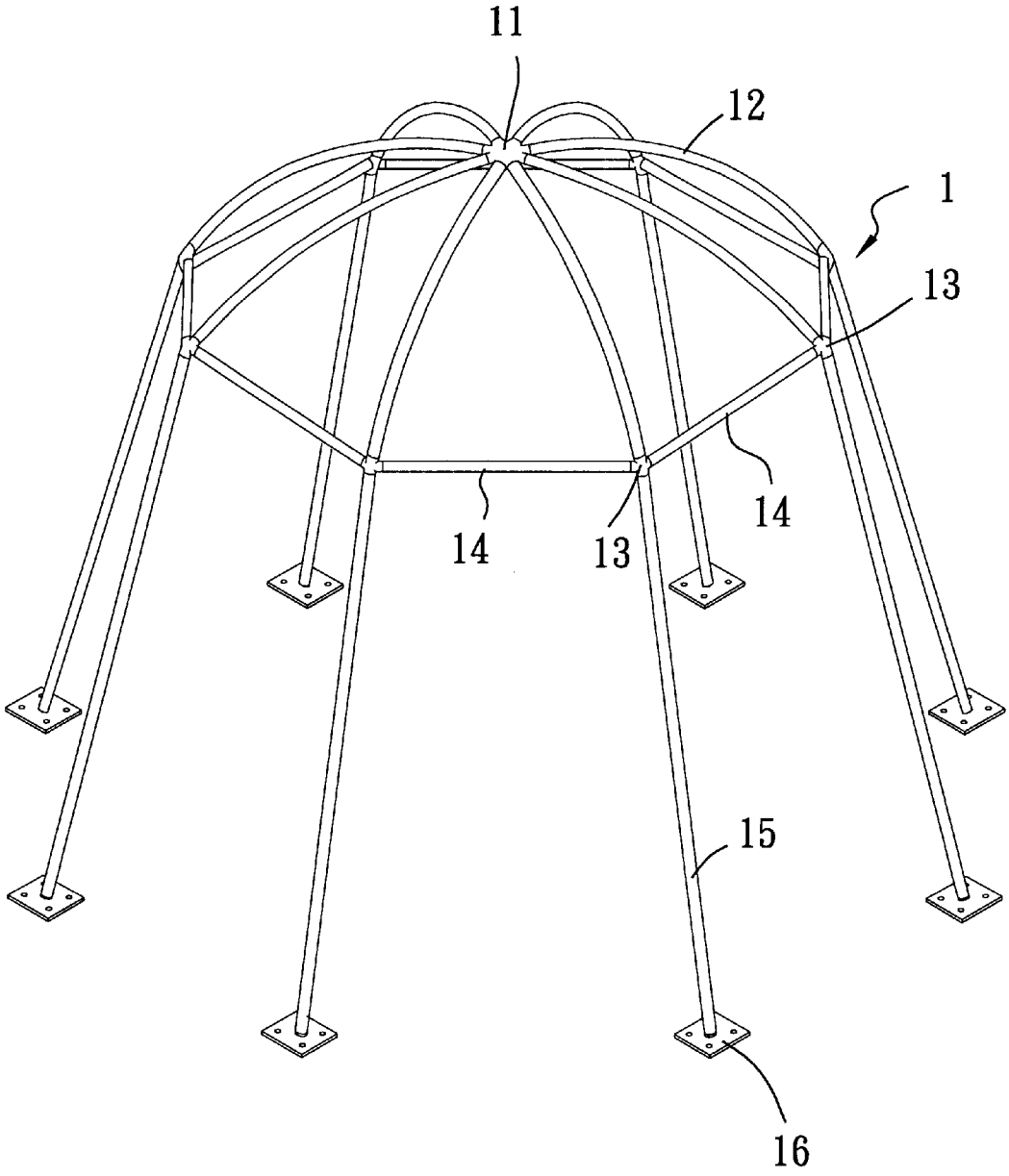
FIG. 1 PRIOR ART
FIG. 1 is a perspective view of a conventional leg assembly for a canopy.
Figure 2:
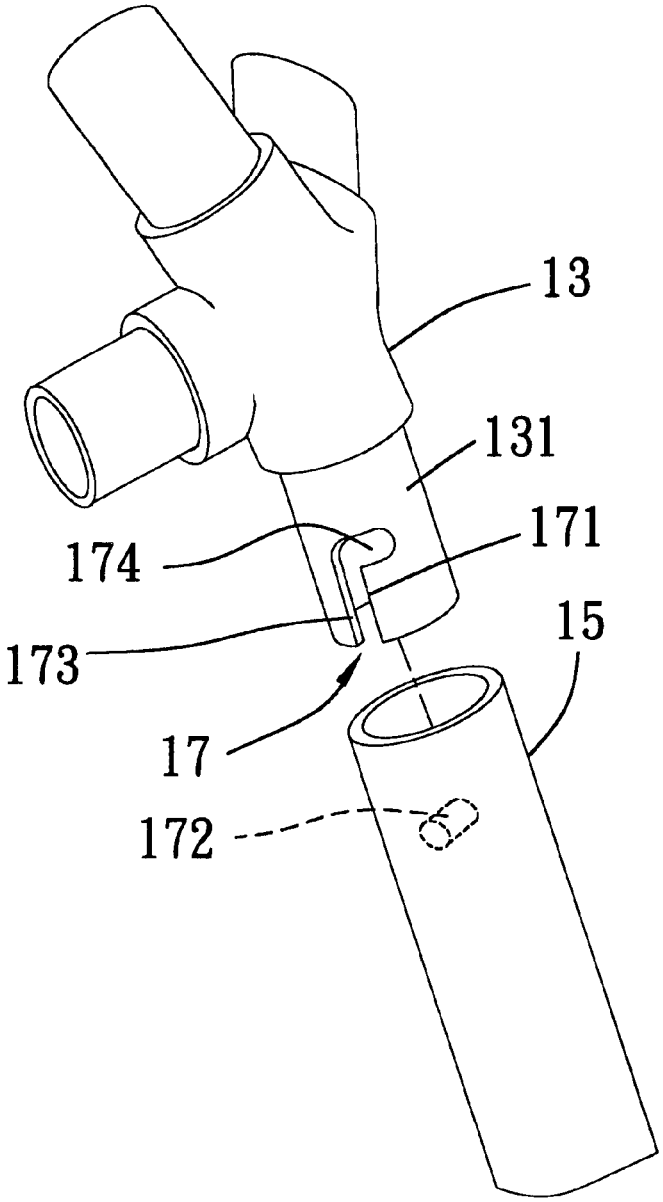
FIG. 2 PRIOR ART
FIG. 2 is a perspective view of an interlocking device of the conventional leg assembly.

Referring to FIGS. 3 to 8, the preferred embodiment of a modular leg assembly 100 according to the present invention is used for mounting a canopy (not shown) thereon, and is shown to comprise four upright support members 2, an annular link frame 3, and a top support frame 4.

Since the upright support members 2 (see FIGS. 3 and 4) are generally similar in construction, only one of the support members 2 will be described in the succeeding paragraph.

The support member 2 includes an adjacent pair of planar first and second leg frames 21, 22 (see FIGS. 3 to 5) that are connected detachably to each other and that are adapted to stand on a ground surface, two leg support pads 23, two insert members 24, and two engaging pieces 25. Each of the first and second leg frames 21, 22 has a vertical engaging side 211, 221 and a vertical non-engaging side 212, 222 opposite to the vertical engaging side 211, 221. The vertical engaging and non-engaging sides 211, 221, 212, 222 are shaped as posts. The vertical engaging side 211, 221 of each of the first and second leg frames 21, 22 has a top end portion 213, 223 that extends higher than a top end portion 217, 227 of the vertical non-engaging side 212, 222 of the respective one of the first and second leg frames 21, 22. The vertical engaging side 211 of the first leg frame 21 is formed with a pair of upper and lower engaging holes 214 (see FIG. 5), which are spaced apart from each other along a vertical direction. Each of the upper and lower engaging holes 214 in the first leg frame 21 includes a circular upper hole portion 215 and a uniform-width lower hole portion 216 that has a width smaller than the diameter of the upper hole portion 215 and that is in communication with the upper hole portion 215. The vertical engaging side 221 of the second leg frame 22 is provided with a pair of upper and lower engaging pins 224 (see FIG. 5) for engaging respectively the upper and lower engaging holes 214 in the vertical engaging side 211 of the first leg frame 21 so as to fix relative positions of the first and second leg frames 21, 22. Each of the upper and lower engaging pins 224 of the second leg frame 22 is formed with a small-diameter pin section 225 that extends through the lower hole portion 216 of the respective one of the upper and lower engaging holes 214 in the first leg frame 21, and a large-diameter pin section 226 that extends outwardly and integrally from the small-diameter pin section 225 and that has a diameter which is slightly smaller than that of the upper hole portion 215 of the respective one of the upper and lower engaging holes 214 in the first leg frame 21. The small-diameter pin sections 225 of the second leg frame 22 are movable upwardly along the lower hole portions 216 to the upper hole portions 215 of the first leg frame 21 so as to permit removal of the upper and lower engaging pins 224 from the upper hole portions 215 of the first leg frame 21. The insert members 24 (see FIG. 5) are formed with stake ends. The insert members 24 and the leg support pads 23 are connected to bottom ends of the vertical non-engaging sides 212, 222 of the first and second leg frames 21, 22 by means of a plurality of screws 20 so that the first and second leg frames 21, 22 can be stably supported on a ground surface when the stake ends of the insert members 24 are inserted into the ground surface. The engaging pieces 25 are mounted fixedly and respectively on the top end portions 217, 227 of the vertical non-engaging sides 212, 222 of the first and second leg frames 21, 22.

Figure 3:
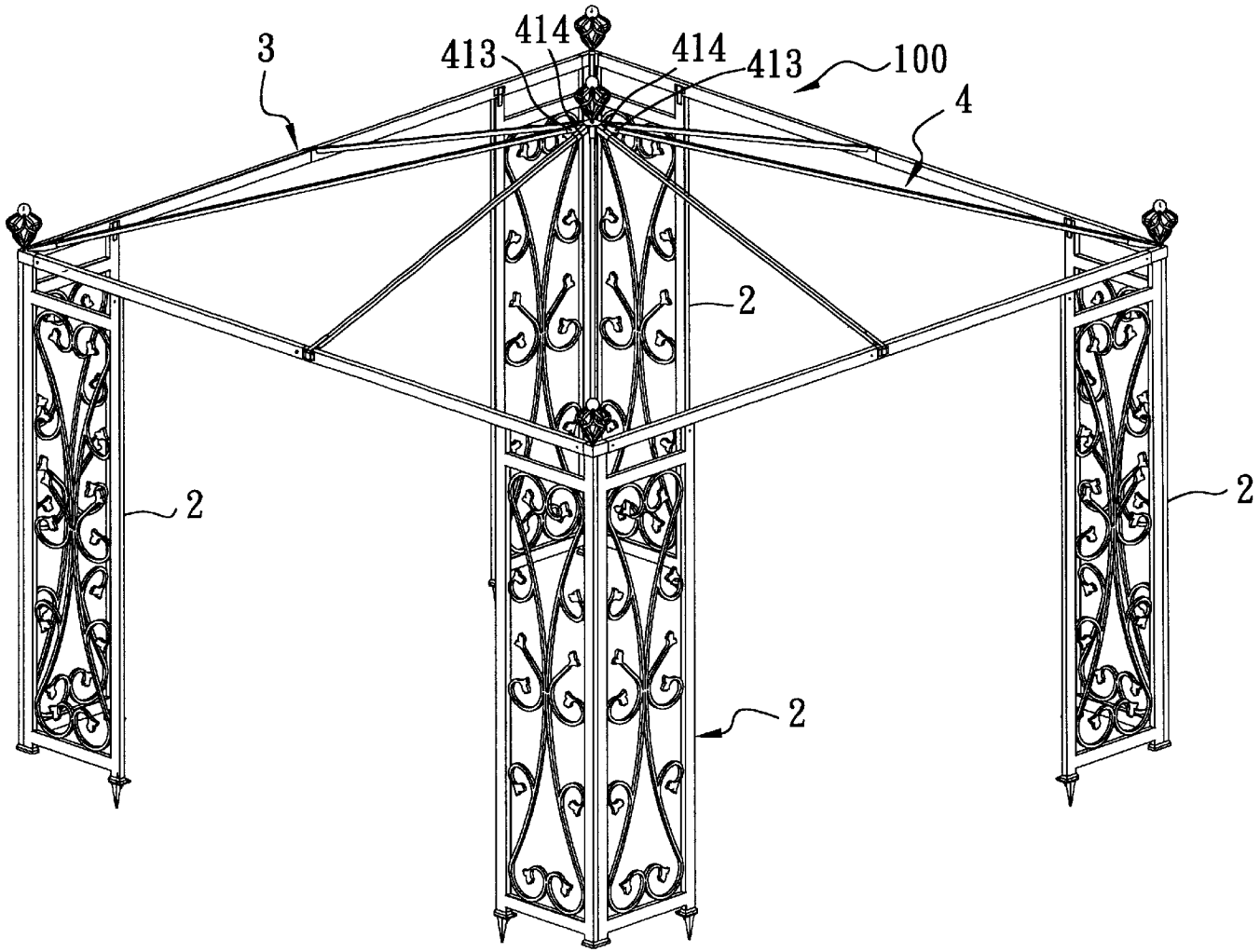
FIG. 3 is a perspective view of the preferred embodiment of a modular leg assembly according to the present invention in an assembled state.
Figure 4:
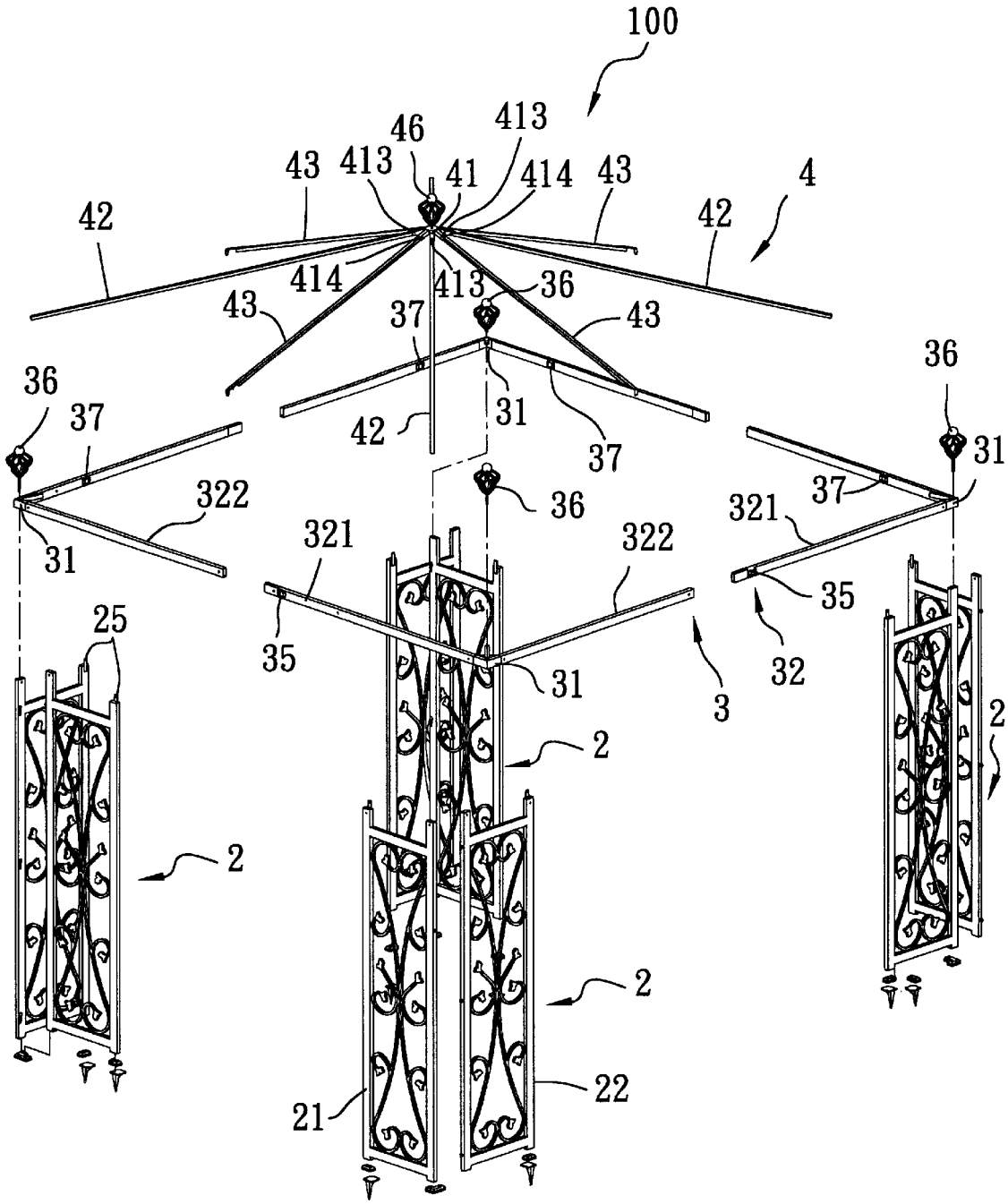
FIG. 4 is a partly exploded perspective view of the preferred embodiment.
Figure 5:
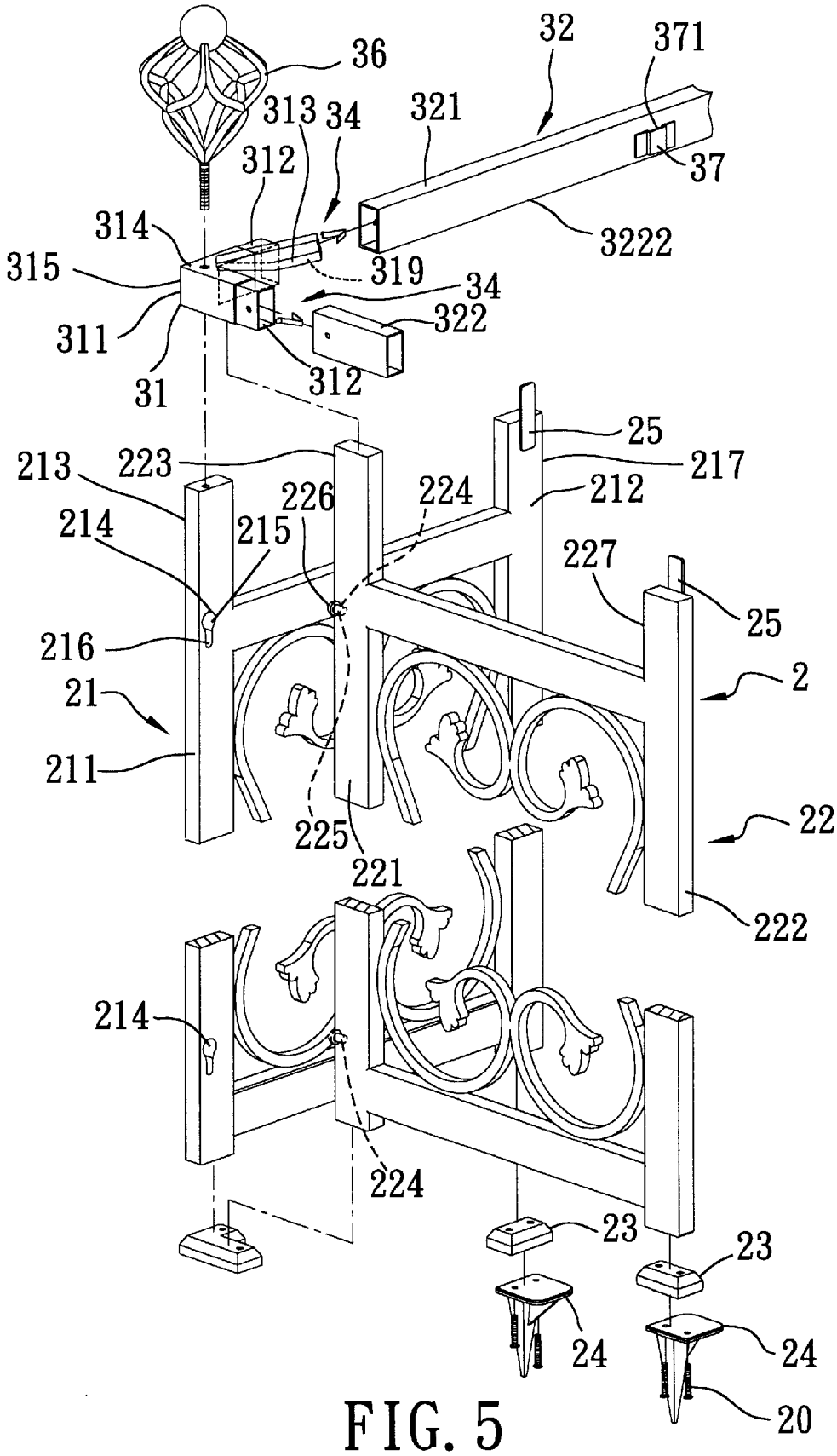
FIG. 5 is a partly exploded fragmentary perspective view of the preferred embodiment, illustrating how a corner connector of an annular link frame engages first and second leg frames of an upright support member.

The annular link frame 3 (see FIGS. 3 and 4) is mounted on a top end of each of the support members 2, and includes four corner connectors 31, four horizontally-extending link members 32, four pairs of first positioning units 34 (see FIGS. 5, 6, and 7) four retaining units 33 (see FIGS. 6 and 7), four first engaging seats 35 (only two are visible in FIG. 4), four side decorative units 36, and eight second engaging seats 37 (only four are visible in FIG. 4). Each of the corner connectors 31 is connected detachably to the top end portions 213, 223 of the first and second leg frames 21, 22 of a respective one of the support members 2, and is formed integrally from a plastic material, but can also be made from a metal material. Since the corner connectors 31 are generally similar in construction, only one of the corner connectors 31 will be described in the succeeding paragraph.

The corner connector 31 includes an L-shaped limb portion 311, which has two tubular ends 312, and an inclined limb member 313. Each of the tubular ends 312 of the L-shaped limb portion 311 has a rectangular cross-section, and a wall that is formed with a through hole 316 therethrough. The inclined limb member 313 (see FIGS. 5 and 7) is a hollow rod body with a rectangular cross-section, has a wall formed with a through hole 319 therethrough, and is fixed to and extends upwardly and inclinedly from a top surface 314 of the L-shaped limb portion 311 toward the top support frame 4. The L-shaped limb portion 311 includes a surrounding wall 315 that extends downwardly from a periphery of the top surface 314 so as to define an L-shaped slot 317 (see FIG. 6), which has two straight slot portions 317', 317" that are perpendicular to each other for receiving respectively the top end portions 213, 223 of the vertical engaging sides 211, 221 of the first and second leg frames 21, 22 of the respective one of the support members 2 therein.

Figure 6:
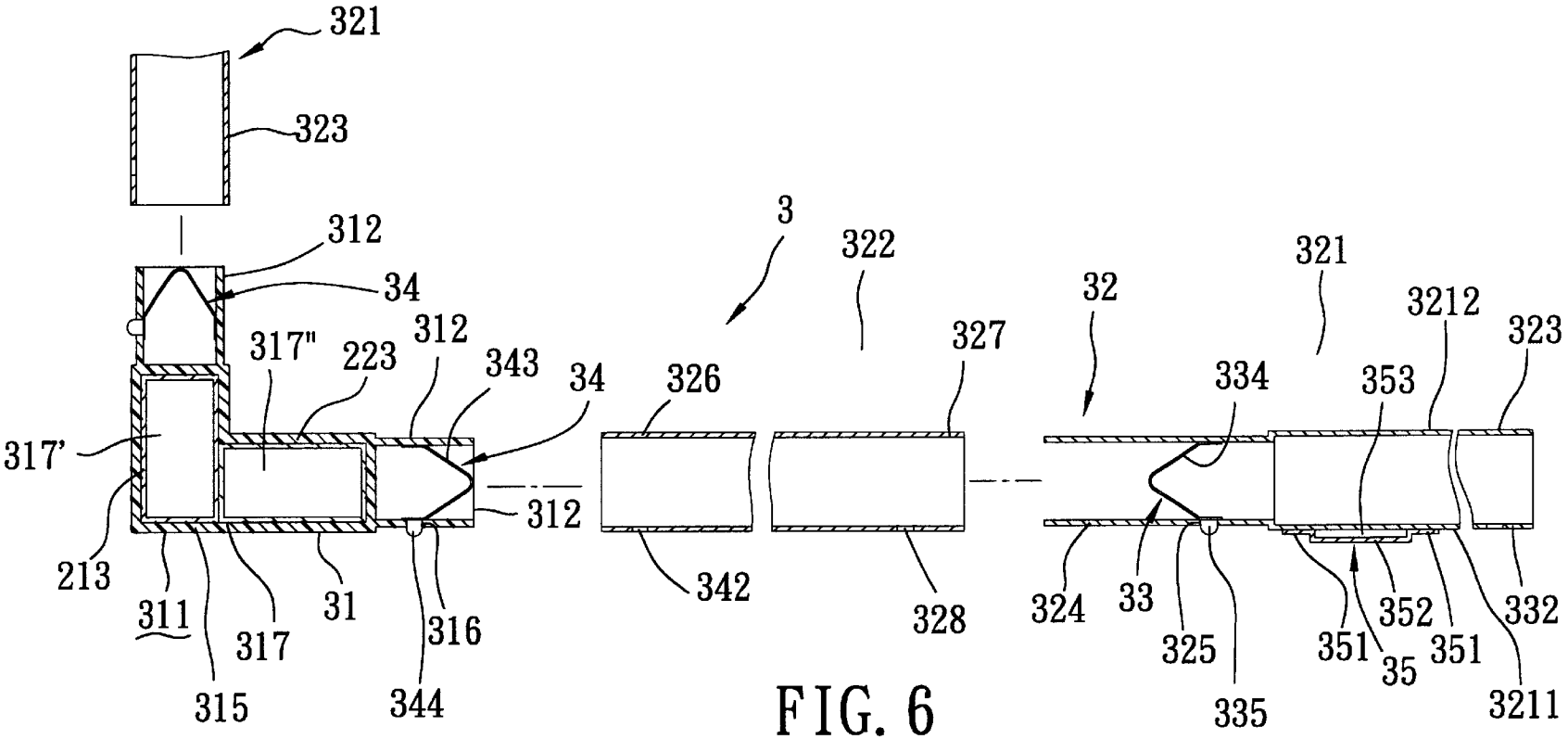
FIG. 6 is a fragmentary top sectional view of the link frame of the preferred embodiment.
Figure 7:
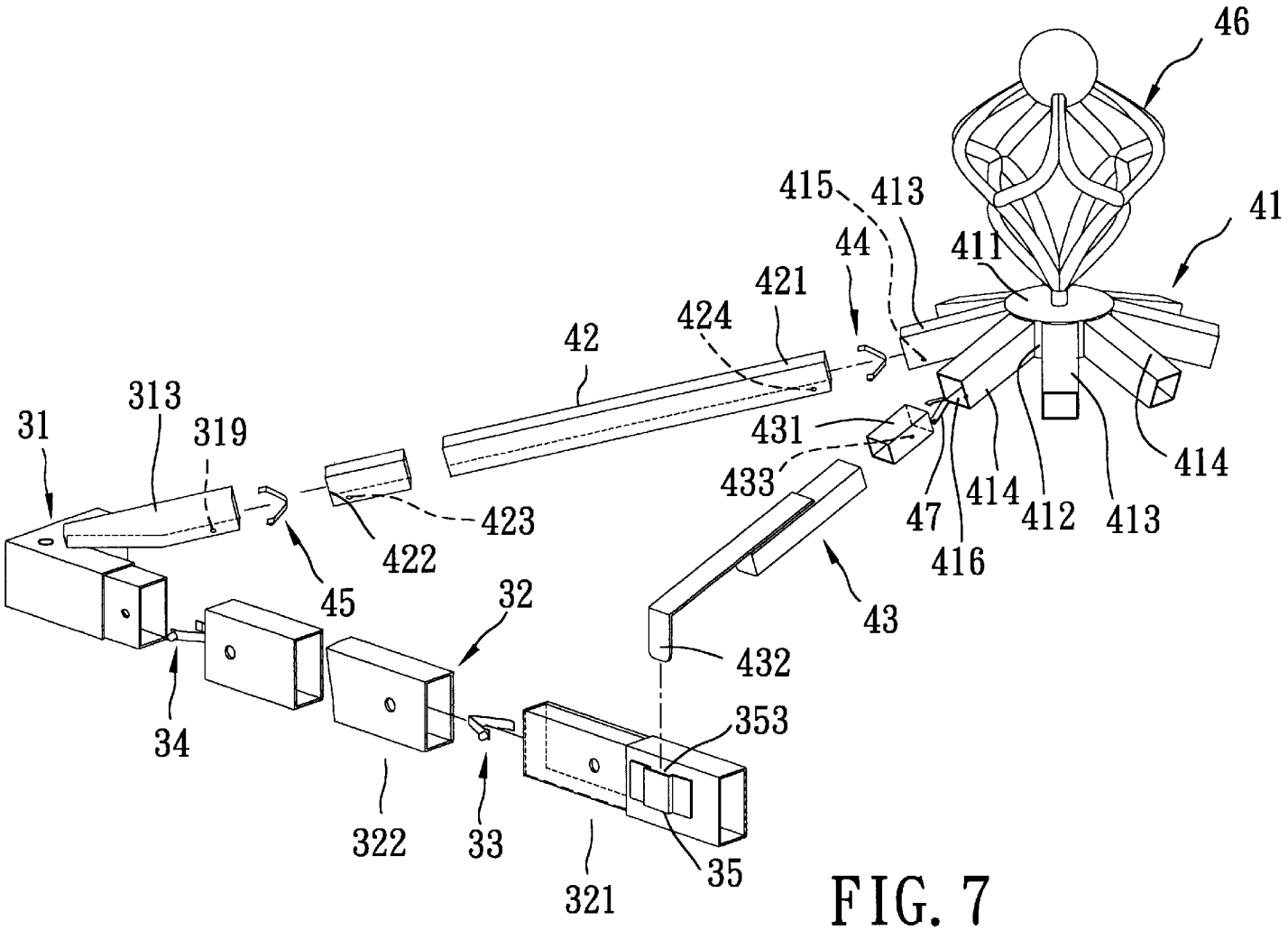
FIG. 7 is a partly exploded fragmentary perspective view of the preferred embodiment, illustrating how the link frame and a top support frame are interconnected.

Each of the link members 32 is connected telescopically to an adjacent pair of the corner connectors 31, and includes a pair of telescopically interconnected first and second link tubes 321, 322 (see FIGS. 6 and 7). Each of the first and second link tubes 321, 322 of each of the link members 32 has a limb-engaging end portion 323, 326 that engages a respective one of the tubular ends 312 of the limb portion 311 of the respective one of the corner connectors 31 and that is formed with a retaining hole 332, 342 therethrough, and a link-connecting end portion 324, 327 connected telescopically to the other one of the first and second link tubes 321, 322.

Each pair of the first positioning units 34 are provided for positioning a respective one of the link members 32 between the adjacent pair of the corner connectors 31. Each of the first positioning units 34 is disposed between a respective one of the tubular ends 312 of the limb portion 311 of a corresponding one of the corner connectors 31 and a respective one of the first and second leg frames 21, 22, and includes a retaining block 344 that extends through the through hole 316 in the respective one of the tubular ends 312 of the limb portions 311, and a biasing member 343 for biasing an end of the retaining block 344 to project from the through hole 316 in the respective one of the tubular ends 312 of the limb portions 311 to engage the retaining hole 332, 342 in a respective one of the first and second link tubes 321, 322 so as to retain the respective one of the first and second link tubes 321, 322 on the corresponding one of the corner connectors 31, thereby preventing movement of the respective one of the first and second link tubes 321, 322 relative to the corresponding one of the corner connectors 31. The end of each of the retaining blocks 344 of the first positioning units 34 is operable to separate from the retaining hole 332, 342 in the respective one of the first and second link tubes 321, 322 so as to permit movement of the respective one of the first and second link tubes 321, 322 relative to the corresponding one of the corner connectors 31.

Each of the retaining units 33 is disposed between the link-connecting end portions 324, 327 of the first and second link tubes 321, 322 of a respective one of the link members 32. The link-connecting end portions 324, 327 of the first and second link tubes 321, 322 are formed respectively with a through hole 325 and a retaining hole 328. Each of the retaining units 33 includes a retaining block 335 that extends through the through hole 325 in the link-connecting end portion 324 of the first link tube 321 of the respective one of the link members 32, and a biasing member 334 for biasing an end of the retaining block 335 to project from the through hole 325 in the link-connecting end portion 324 of the first link tube 321 of the respective link member 32 to engage the retaining hole 328 in the link-connecting end portion 327 of the second link tube 322 of the respective link member 32 so as to retain the first link tube 321 on the second link tube 322 of the respective one of the link members 32.

Each of the first engaging seats 35 is mounted fixedly on a respective one of the link members 32, and includes two opposite side portions 351 (see FIGS. 6 and 7) connected fixedly to an outer wall 3211 (see FIG. 7) of the first link tube 321 of the respective one of the link members 32, and a U-shaped portion 352 that is connected integrally between the side portions 351 and that cooperates with the outer wall 3211 of the first link tube 321 of the respective link member 32 to define a first positioning groove 353 therebetween.

Each of the side decorative units 36 is mounted threadedly on the top surface 314 of a respective one of the corner connectors 31.

Each of the second engaging seats 37 is disposed fixedly on an inner wall 3212, 3222 (see FIGS. 5 and 6) of a respective one of the first and second link tubes 321, 322 so as to define a second positioning groove 371 for upward insertion of a respective one of the engaging pieces 25 of the first and second leg frames 21, 22 of the support members 2 therethrough.

The top support frame 4 (see FIGS. 3, 4, and 7) is mounted detachably on the link frame 3, and includes a central connector 41, four main support rod members 42 (only three are visible in FIGS. 3 and 4), four auxiliary support rod members 43, four second positioning units 44, four third positioning units 45, a central decorative unit 46, and four fourth positioning units 47.

The central connector 41 includes a top wall 411, a surrounding wall 412 that extends downwardly from a periphery of the top wall 411, four angularly spaced-apart main connecting portions 413 (only three are visible in FIGS. 3 and 4) that extend outwardly, radially, and respectively from the surrounding wall 412 toward the inclined limb members 313 of the corner connectors 31, and four auxiliary connecting portions 414 (only two are visible in FIGS. 3 and 4) that extend outwardly, radially, and respectively from the surrounding wall 412 toward the first engaging seats 35. Each of the main connecting portions 413 has a wall formed with a retaining hole 415. Each of the auxiliary connecting portions 414 is disposed between an adjacent pair of the main connecting portions 413, and has a wall formed with a retaining hole 416 therethrough.

Each of the main support rod members 42 is connected telescopically to a respective one of the inclined limb members 313 and a respective one of the main connecting portions 413, and has a limb-engaging end portion 422 that engages the respective one of the inclined limb members 313 of the corner connectors 31 and that is formed with a retaining hole 423 through a wall thereof, and a connector-engaging end portion 421 that engages the respective one of the main connecting portions 413 and that is formed with a through hole 424 through a wall thereof.

Figure 8:
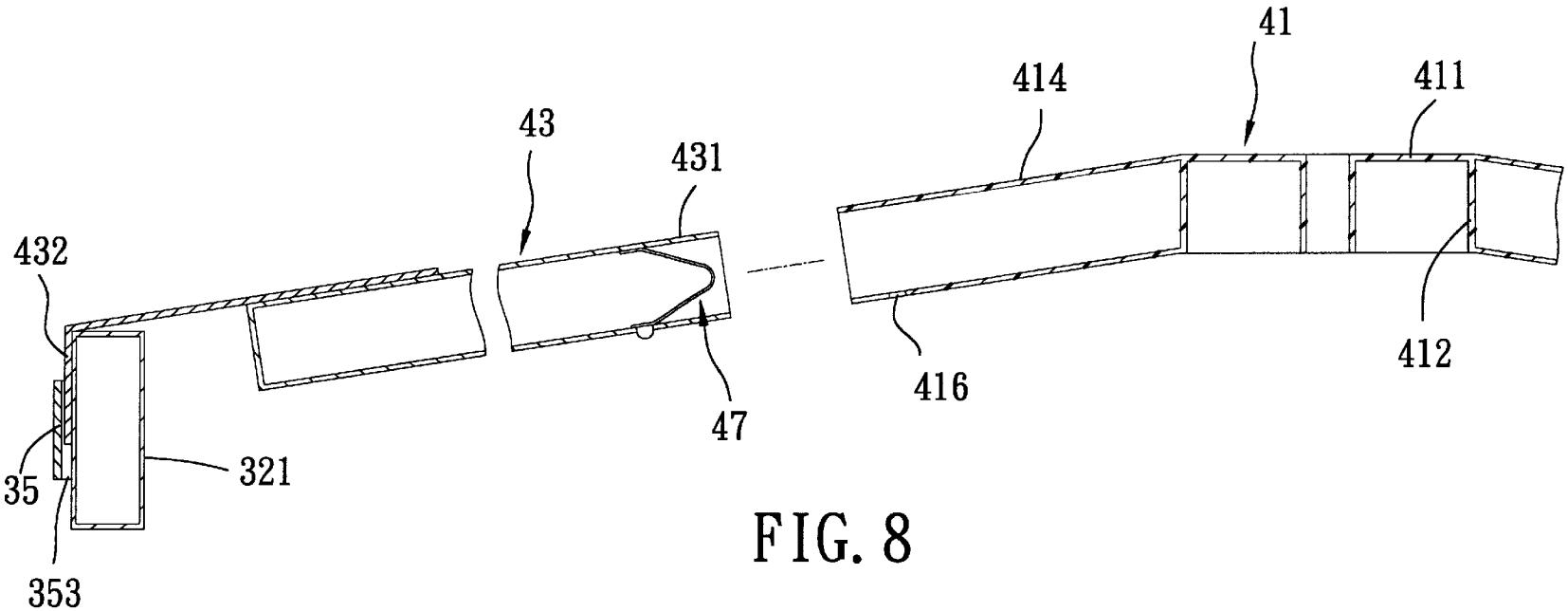
FIG. 8 is a fragmentary sectional view of the preferred embodiment, illustrating how an auxiliary support rod member of the top support frame is connected to the link frame.

Each of the auxiliary support rod members 43 (see FIG. 7) is connected telescopically to a respective one of the auxiliary connecting portions 414, and has a downwardly extending insert element 432 that is inserted into a respective one of the first positioning grooves 35, as best shown in FIG. 8, and a connector-engaging end portion 431 that engages a respective one of the auxiliary connecting portions 414 and that is formed with a through hole 433 through a wall thereof.

Each of the second positioning units 44 is disposed between the connector-engaging end portion 421 of a respective one of the main support rod members 42 and a respective one of the main connecting portions 413 of the central connector 41, and is provided for positioning the respective one of the main connecting portions 413 of the central connector 41 relative to the respective one of the main support rod members 42. Each of the third positioning units 45 is disposed between the inclined limb member 313 of a respective one of the corner connectors 31 and the limb-engaging end portion 422 of a respective one of the main support rod members 42, and is provided for positioning the respective one of the main support rod members 42 relative to the respective one of the corner connectors 31. Each of the fourth positioning units 47 is disposed between the connector-engaging end portion 431 of a respective one of the auxiliary support rod members 43 and a respective one of the auxiliary connecting portions 414 of the central connector 41, and is provided for positioning the respective one of the auxiliary support rod members 43 relative to a respective one of the auxiliary connecting portions 414 of the central connector 41. Since the design of and the operating principle involved in each of the second, third, and fourth positioning units 44, 45, 47 is substantially similar to that of the first positioning units 34 described before hand, a detailed description of the same will be dispensed with herein for the sake of brevity.

The central decorative unit 46 is mounted threadedly on the top wall 411 of the central connector 41.

During assembly, the first and second leg frames 21, 22 of each of the support members 2 are engaged initially by inserting the upper and lower engaging pins 224 of the second leg frame 22 of a respective one of the support members 2 into the upper and lower engaging holes 214 in the first leg frame 21 of the corresponding support member 2 such that the vertical engaging sides 211, 221 of the first and second leg frames 21, 22 of each of the support members 2 are close to and are connected detachably to each other, and such that the vertical non-engaging sides 212, 222 of the first and second leg frames 21, 22 of the corresponding support member 2 are spaced apart from each other. The insert members 24 and the leg support pads 23 are then connected respectively to the bottom ends of the vertical non-engaging sides 212, 222 of the first and second leg frames 21, 22 of the corresponding support member 2, and the stake ends of the insert members 24 are inserted into the ground surface. Each of the corner connectors 31 is sleeved on the top end portions 213, 223 of the vertical engaging sides 211, 221 of the first and second leg frames 21, 22 of the support members 2. The following step is to interconnect the first and second link tubes 321, 322 of each of the link members 32 of the link frame 3 using the retaining units 33, after which each of the link members 32 are connected to the adjacent pair of the corner connectors 31 through the first positioning units 34. The engaging pieces 25 on each of the support members 2 are inserted respectively into the second positioning grooves 371 in the second engaging seats 37 so as to secure more firmly the link frame 3 on the four support members 2. Afterwards, the connector-engaging end portions 421, 431 of the main and auxiliary support rod members 42, 43 of the top support frame 4 are connected respectively to the main and auxiliary connecting portions 413, 414 of the central connector 41 by the use of the second and fourth positioning units 44, 47, respectively. The limb-engaging end portions 422 of the main support rod members 42 are connected respectively to the inclined limb members 313 of the corner connectors 31 through the third positioning units 45. The downwardly extending insert elements 432 of the auxiliary support rod members 43 are inserted respectively into the first positioning grooves 353 in the first engaging seats 35. Finally, the side decorative units 36 are mounted threadedly and respectively on the top surfaces 314 of the corner connectors 31, and the central decorative unit 46 is mounted threadedly on the top wall 411 of the central connector 41, thereby completing the modular leg assembly 100 of the present invention, as best shown in FIG. 3.

The assembled state of the modular leg assembly 100 shown in FIG. 3 can be transformed into a disassembled state shown in FIG. 4 using the same principle. The retaining block of each third positioning unit 45 is pushed inwardly so as to separate the same from the retaining hole 422 in a respective one of the main support rod members 42, after which the entire top support frame 4 is removed from the link frame 3. Then, the retaining blocks of the second and fourth positioning units 44, 47 are pushed inwardly so as to separate the same from the respective retaining holes 415, 416 in the main and auxiliary connecting portions 413, 414 of the central connector 41. A similar method is applied for disassembling the first and second link tubes 321, 322 of the link frame 3 from the adjacent pair of the corner connectors 31 and from one another. To disassemble each support member 2, the second leg frame 22 of each support member 2 is lifted upwardly until the large-diameter pin sections 226 of the upper and lower engaging pins 224 of the second leg frame 22 are registered with the upper hole portions 215 of the upper and lower engaging holes 214 in the first leg frame 21 of the corresponding support member 2. Then, the second leg frame 22 of each support member 2 is removed from the first leg frame 21 of the corresponding support member 2, thereby completely disassembling the modular leg assembly 100 for storage.

The structural design of the modular leg assembly 100 of the present invention is not limited to include four upright support members 2. The modular leg assembly can be modified to include only three upright support members 2 without affecting the ability to support the canopy thereon.

From the above description of the preferred embodiment of the modular leg assembly 100 of the present invention, it is apparent that the modular leg assembly 100 can support the canopy more stably due to the configuration of the upright support members 2. Furthermore, the distance between adjacent support members 2 can be increased so as to facilitate passage therethrough. Moreover, assembly and disassembly of the present invention only involve insertion and pushing of the retaining blocks of the positioning units so as to engage and separate members of the modular leg assembly 100, which is more simpler as compared to the conventional leg assembly 1.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A modular leg assembly for a canopy, said leg assembly comprising:

at least three upright support members, each of which includes an adjacent pair of planar first and second leg frames that are connected detachably to each other and that are adapted to stand on a ground surface, each of said first and second leg frames including a vertical engaging side and a vertical non-engaging side opposite to said vertical engaging side, wherein during assembly, said vertical engaging sides of said first and second leg frames of each of said support members are close to and are connected detachably to each other, and said vertical non-engaging sides of said first and second leg frames of each of said support members are spaced apart from each other;

an annular link frame mounted on a top end of each of said support members, said link frame including a plurality of corner connectors, each of which is connected detachably to a respective one of said support members, a plurality of horizontally-extending link members, each of which is connected telescopically to an adjacent pair of said corner connectors, and a plurality of first positioning units for positioning each of said link members between said adjacent pair of said corner connectors; and a top support frame mounted detachably on said link frame, said top support frame including a central connector, a plurality of main support rod members, each of which is connected telescopically to said central connector and a respective one of said corner connectors, a plurality of second positioning units for positioning said central connector relative to said main support rod members, and a plurality of third positioning units for positioning said main support rod members relative to said corner connectors.

2. The modular leg assembly of claim 1, wherein said vertical engaging side of said first leg frame of each of said support members is formed with a pair of upper and lower engaging holes which are spaced apart from each other along a vertical direction, said vertical engaging side of said second leg frame of each of said support members being provided with a pair of upper and lower pins for engaging respectively said upper and lower engaging holes in said vertical engaging side of said first leg frame of the respective one of said support members so as to fix relative positions of said first and second leg frames of the respective one of said support members.

3. The modular leg assembly of claim 2, wherein each of said upper and lower engaging holes in said vertical engaging side of said first leg frame of each of said support members includes a circular upper hole portion and a uniform-width lower hole portion that has a width smaller than diameter of said upper hole portion and that is in communication with said upper hole portion, each of said upper and lower pins of said vertical engaging side of said second leg frame being formed with a small-diameter pin section that extends through said lower hole portion of the respective one of said upper and lower engaging holes, and a large-diameter pin section that extends outwardly and integrally from said small-diameter pin section and that has a diameter which is slightly smaller than that of said upper hole portion of the respective one of said upper and lower engaging holes, said small-diameter pin sections of said upper and lower pins being movable upwardly along said lower hole portions into said upper hole portions so as to permit removal of said upper and lower pins from said upper hole portions of said upper and lower engaging holes.

4. The modular leg assembly of claim 1, wherein each of said upright support members further includes two insert members that are mounted respectively on bottom ends of said vertical non-engaging sides of said first and second leg frames and that are adapted to be inserted into a ground surface.

5. The modular leg assembly of claim 1, wherein:

each of said corner connectors includes an L-shaped limb portion, which has two tubular ends, each of which has a wall that is formed with a through hole therethrough, each of said link members including a pair of telescopically interconnected first and second link tubes, each of which has a limb-engaging end portion that engages a respective one of said tubular ends of said limb portions and that is formed with a retaining hole therethrough, and a link-connecting end portion connected telescopically to the other one of said first and second link tubes, each of said first positioning units including a retaining block that extends through said through hole in a respective one of said limb portions, and a biasing member for biasing an end of said retaining block to project from said through hole in the respective one of said limb portions to engage said retaining hole in a respective one of said first and second link tubes so as to retain the respective one of said first and second link tubes on the respective one of said corner connectors, thereby preventing movement of the respective one of said first and second link tubes relative to the respective one of said corner connectors, said end of each of said retaining blocks being operable to separate from said retaining hole in the respective one of said first and second link tubes so as to permit movement of the respective one of said first and second link tubes relative to the respective one of said corner connectors.

6. The modular leg assembly of claim 5, wherein said link frame further includes a plurality of retaining units, each of which is disposed between said link-connecting end portions of said first and second link tubes of a respective one of said link members, said link-connecting end portions of said first and second link tubes of each of said link members being formed respectively with a through hole and a retaining hole, each of said retaining units including a retaining block that extends through said through hole in said link-connecting end portion of said first link tube of the respective one of said link members, and a biasing member for biasing an end of said retaining block to project from said through hole in said link-connecting end portion of the respective one of said first link tubes to engage said retaining hole in said link-connecting end portion of said second link tube of the respective one of said link members so as to retain said first link tube on said second link tube of the respective one of said link members.

7. The modular leg assembly of claim 5, wherein:

each of said L-shaped limb portions has a top surface, each of said corner connectors further including an inclined limb member that is fixed to and that extends upwardly and inclinedly from said top surface of the respective one of said L-shaped limb portions toward said central connector of said top support frame, said central connector of said top support frame including a top wall, a surrounding wall that extends downwardly from a periphery of said top wall, and a plurality of angularly spaced-apart main connecting portions that extend outwardly, radially, and respectively from said surrounding wall toward said inclined limb members of said corner connectors, each of said main support rod members being connected telescopically to a respective one of said inclined limb members and a respective one of said main connecting portions.

8. The modular leg assembly of claim 7, wherein:

said link frame further includes a plurality of first engaging seats, each of which is mounted fixedly on a respective one of said link members so as to define a first positioning groove therebetween, said central connector of said top support frame further including a plurality of auxiliary connecting portions that extend outwardly, radially, and respectively from said surrounding wall toward said first engaging seats, said top support frame further including a plurality of auxiliary support rod members, each of which is connected telescopically to a respective one of said auxiliary connecting portions and has a downwardly extending insert element that is inserted into a respective one of said first positioning grooves, and a plurality of fourth positioning units for positioning respectively said auxiliary support rod members relative to said central connector.

9. The modular leg assembly of claim 8, wherein said top support frame further includes a central decorative unit mounted threadedly on said top wall of said central connector, each of said corner connectors of said link frame further including a side decorative unit mounted threadedly on a top surface of a respective one of said corner connectors.

10. The modular leg assembly of claim 5, wherein said vertical engaging side of each of said first and second leg frames has a top end portion that extends higher than that of the vertical non-engaging side of the respective one of said first and second leg frames, said L-shaped limb portion of each of said corner connectors having a top surface and including a surrounding wall that extends downwardly from a periphery of said top surface so as to define an L-shaped slot, which has two straight slot portions that are perpendicular to each other for receiving respectively said top end portions of said vertical engaging sides of said first and second leg frames therein.

11. The modular leg assembly of claim 10, wherein each of said upright support members further includes two engaging pieces mounted fixedly and respectively on said vertical non-engaging sides of said first and second leg frames, said link frame further including a plurality of second engaging seats, each of which is disposed fixedly on a respective one of said first and second link tubes so as to define a second positioning groove for upward insertion of a respective one of said engaging pieces of said support members therethrough.

* * * * *